United States Patent [19]

Morito et al.

[11] 4,255,205

[45] Mar. 10, 1981

[54] METHOD OF PRODUCING GRAIN-ORIENTED SILICON STEEL SHEETS HAVING SUBSTANTIALLY NO GLASS FILM

[75] Inventors: Nobuyuki Morito; Toshitomo Sugiyama; Yoshio Obata, all of Kobe, Japan

[73] Assignee: Kawasaki Steel Corporation, Kobe, Japan

[21] Appl. No.: 102,761

[22] Filed: Dec. 12, 1979

[30] Foreign Application Priority Data

Dec. 27, 1978 [JP] Japan ..... 53-159967

[51] Int. Cl.[3] ..... C23F 7/10; H01F 1/04

[52] U.S. Cl. ..... 148/113; 148/6.2; 148/6.16; 427/104

[58] Field of Search ..... 148/113, 111, 27, 6.16, 148/6.2; 106/286.6; 427/104

[56] References Cited

U.S. PATENT DOCUMENTS

| | | | |
|---|---|---|---|
| 3,582,407 | 6/1971 | Steger et al. | 148/27 |
| 4,120,702 | 10/1978 | Akerblom | 148/113 |

FOREIGN PATENT DOCUMENTS

| | | | |
|---|---|---|---|
| 46-27926 | 8/1971 | Japan | 148/27 |

*Primary Examiner*—Ralph S. Kendall

*Attorney, Agent, or Firm*—Balogh, Osann, Kramer, Dvorak, Genova & Traub

[57] ABSTRACT

A grain-oriented silicon steel sheet having substantially no glass film can be obtained by subjecting a cold rolled silicon steel sheet having a final gauge to a decarburization annealing to form subscale on the steel sheet surface, applying an annealing separator consisting of hydrated silicate mineral fine powder, a strontium- or barium-containing compound, calcium oxide or calcium hydroxide and the remainder being $Al_2O_3$, and finally annealing the above treated steel sheet. The steel sheet has excellent punchability when the steel sheet is coated with a phosphate system or chromate-organic resin mixture system insulating coating.

4 Claims, 3 Drawing Figures

(x 600)

(x 600)

(a) Glass Film + Phosphate System Insulating Coating (b) No Glass Film + Phosphate System Insulating Coating (c) No Glass Film + Chromate-Organic Resin Mixture System Insulating Coating

METHOD OF PRODUCING GRAIN-ORIENTED SILICON STEEL SHEETS HAVING SUBSTANTIALLY NO GLASS FILM

BACKGROUND OF THE INVENTION (1) Field of the Invention

The present invention relates to a method of producing grain-oriented silicon steel sheets, and more particularly, to a method of producing grain-oriented silicon steel sheets, which can be easily separated from an annealing separator after final annealing and have substantially no glass film and have excellent punchability and magnetic properties.

(2) Description of the Prior Art

Grain-oriented silicon steel sheets have hitherto been produced by a series of steps, wherein a silicon steel containing not more than 4.0% of silicon is hot rolled, the hot rolled sheet is annealed and then subjected to one cold rolling or two cold rollings to produce a cold rolled sheet having a final gauge, the cold rolled sheet is subjected to a primary recrystallization and concurrently to a decarburization annealing to form subscale consisting mainly of $SiO_2$ on the steel sheet surface, an annealing separator consisting mainly of MgO is applied to the steel sheet, the above treated steel sheet is subjected to a final annealing to develop secondary recrystallized grains having (110) (001) orientation and concurrently to remove harmful impurities and to form forsterite glass film having a thickness of 2–5 $\mu$m.

In general, a phosphate series insulating coating is formed on the above described forsterite glass film to produce a final steel sheet product. However, since the forsterite film has a very high hardness, a metal die is seriously worn during the punching of steel sheets having the forsterite film. Therefore, when rigid glass film is not formed during the final annealing, the wear of metal die during the punching can be prevented, and the punchability of the metal die can be improved. The punchability of a metal die is represented by the number of punched sheets without wearing of the die.

Further, when the glass film of grain-oriented silicon steel sheet is removed and the steel sheet is mirror-finished as commonly known, the magnetic induction of the steel sheet is remarkably increased, and the iron loss thereof is noticeably improved at the same time. Treating methods for steel sheet, which do not form glass films on the steel sheet during the final annealing, are demanded so that the mirror finishing of the finally annealed steel sheet can be easily carried out.

In any of methods proposed as a treating method, which does not form glass film with the use of an annealing separator consisting mainly of MgO, glass film is locally formed and a strong pickling must be carried out in order to remove completely the remaining glass film.

When an annealing separator consisting mainly of $Al_2O_3$ is used, since $Al_2O_3$ is inactive, glass film is not newly formed, but subscale formed during the decarburization annealing is aggromelated into coarse particles, and the coarse particles remain near the surface of the finally annealed steel sheet, or the sticking of $Al_2O_3$ on the surface occurs. Therefore, a strong pickling must be carried in order to remove the coarse particles or the sticked $Al_2O_3$. Such strong pickling not only consumes acid, but also solves excessively steel sheet. One of methods for extinguishing subscale remaining in a steel sheet is to carry out decarburization annealing under an atmosphere having a low oxidizing ability, whereby the thickness of the resulting subscale is made as small as possible and oxide film is formed only on the surface of the steel sheet. However, in order to form such thin oxide film, an atmosphere having an extremely low oxidizing ability must be used, and as the result the decarburization can not be sufficiently carried out and the magnetic properties of the resulting grain-oriented silicon steel sheet is poor.

The inventors have already disclosed in Japanese Patent Laid Open Application No. 22,113/78 a method for producing grain-oriented silicon steel sheets having metallic luster and further having excellent punchability and magnetic properties, and an annealing separator, which is effectively used in this method and can be easily peel off from the finally annealed steel sheet.

The inventors have made further investigations for improving the method of the above described Japanese Patent Laid Open Application No. 22,113/78, and accomplished the present invention.

SUMMARY OF THE INVENTION

The object of the present invention is to provide a method for producing grain-oriented silicon steel sheets having substantially no glass film, which is free from the drawbacks of conventional method using an annealing separator consisting mainly of $Al_2O_3$.

The feature of the present invention is the provision of a method of producing grain-oriented silicon steel sheets having substantially no glass film, wherein a cold rolled silicon steel sheet having a final guage is subjected to a decarburization annealing to form subscale on the surface of the steel sheet, an annealing separator consisting mainly of $Al_2O_3$ is applied on the subscale and then the steel sheet is subjected to a final annealing, an improvement comprising using an annealing separator consisting of 5–30% of hydrated silicte mineral fine particle, 0.2–20%, calculated as strontium or barium, of a compound containing strontium or barium, 2–30% of CaO or $Ca(OH)_2$ and the reminder being $Al_2O_3$.

DESCRIPTION OF THE PREFERRED EMBODIMENT

In the present invention, a decarbonization annealing of a cold rolled steel sheet is carried out under a condition, under which carbon can be fully removed and subscale having a thickness of as small as possible is formed, and further an annealing separator, which can float oxides contained in the steel sheet up to the steel sheet surface, is used, whereby a grain-oriented silicon steel sheet having substantially no glass film is produced.

The reason why a decarburization annealing of a cold rolled steel sheet is carried out so as to form subscale having a small thickness is to float easily oxides during the final annealing. When the distance from the steel sheet surface to the inner end of subscale is larger than 3 μm (3 μm thickness of subscale corresponds to oxygen content in the subscale of about 1.0 g per $m^2$ of one surface of steel sheet), floating up of oxides is very difficult. While, when the oxygen content in the subscale formed on the surface of steel sheet is not larger than 1.0 g per $m^2$ of one surface, glass film is not substantially formed in so far as the annealing separator according to the present invention is used. When it is intended to form subscale having an oxygen content of less than 0.2 g per $m^2$ of one surface of steel sheet by a conventional method, an annealing atmosphere having a low oxidizing ability must be used, and therefore there is a risk of insufficient decarburization when decarburization annealing is carried out in an industrial line velocity. Based on the above described reason, it is necessary that the oxygen content in subscale formed on the surface of steel sheet is 0.2–1.0 g per $m^2$ of one surface.

Since an annealing separator consisting only of $Al_2O_3$ does not shrink during the final annealing, gas can not flow smoothly the space between adjacent coiled steel sheet layers, and it is difficult to remove S, Se and N during the final annealing, which S, Se and N would affect adversely the magnetic properties of the finally annealed steel sheet. When hydrated silicate mineral is contained in an $Al_2O_3$ series annealing separator, the annealing separator liberates water and shrinks during the final annealing, and gas flows smoothly in the space between adjacent coiled steel sheet layers, and as the result, the steel sheet can be easily purified and sticking of $Al_2O_3$ on the surface of steel does not occur. When the amount of hydrated silicate mineral contained in the $Al_2O_3$ series annealing separator is less than 5%, the effect of the hydrated silicate mineral does not appear. While, when the amount is more than 30%, oxides are formed on the steel surface due to liberated water during the final annealing and subscale remains in the finally annealed steel sheet. Accordingly, the amount of hydrated silicate mineral to be contained in the $Al_2O_3$ series annealing separator should be 5–30%. In the present invention, serpentine, talc and the like are used as the hydrated silicate mineral.

Figure 1A:
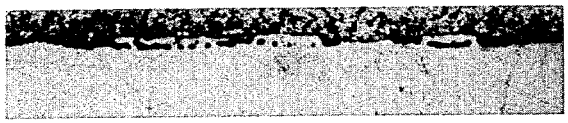
FIG. 1*a* is a photomicrograph (magnifiction: 600) showing a cross-section of a finally annealed steel sheet and a glass film formed thereon when a cold rolled steel sheet is subjected to a decarburization annealing under a condition so as to form subscale containing 0.8g of oxygen per $m^2$ of one surface of the steel sheet, and an annealing separator consisting of 10% of serpentine, 5% of $Ca(OH)_2$ and the remainder being $Al_2O_3$ is applied on the surface of the steel sheet.
Figure 1B:
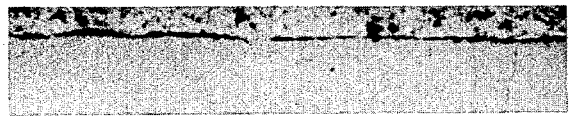
FIG. 1*b* is a photomicrograph (magnification: 600) showing a cross-section of a finally annealed steel sheet and a glass film formed thereon when the same cold rolled steel sheet as that used in the treatment of FIG. 1*a* is treated in the same manner as described above, except that an annealing separator consisting of 10% of serpentine, 5% of $Ca(OH)_2$, 5% of $Sr(OH)_2$ and the remainder being $Al_2O_3$ is applied on the surface of the steel sheet.

The presence of a compound containing strontium or barium in the $Al_2O_3$ series annealing separator serves to float up oxide particles, which have been formed during the decarburization annealing, during the final annealing, and therefore the use of a compound containing strontium or barium is necessary in order not to form glass film. FIG. 1*a* is a photomicrograph (magnifiction: 600) showing a cross-section of a finally annealed steel sheet and a glass film formed thereon, when a cold rolled steel sheet is subjected to a decarburization annealing under a condition so as to form subscale containing a 0.8 g of oxygen per $m^2$ of one surface of the steel sheet, and an annealing separator consisting of 10% of serpentine, 5% of $Ca(OH)_2$ and the remainder being $Al_2O_3$ is applied on the surface of the steel sheet. While, FIG. 1*b* is a photomicrograph (Magnification: 600) showing a cross-section of a finally annealed steel sheet and a glass film formed thereon, when the same cold rolled steel sheet as that used in the treatment of FIG. 1*a* is treated in the same manner as described above, except that an annealing separator consisting of 10% of serpentine, 5% of $Ca(OH)_2$, 5% of $Sr(OH)_2$ and the remainder being $Al_2O_3$ is applied on the surface of the steel sheet. It is clear from FIGS. 1*a* and 1*b* that the use of a strontium-containing compound is effective for floating oxides. The use of a barium-containing compound is also effective similarly to the use of a strontium-containing compound. The above described effect of strontium or barium is probably due to the reason that strontium or barium increases the interfacial surface energy between oxides and iron substrate, and can be understood from the phenomenon that oxide particles remaining in the steel are eventually formed into coarse globular shape when an annealing separator containing strontium or barium is used. When the amount of strontium- or barium-containing compound contained in the annealing separator is less than 0.2%, calculated s strontium or barium, the effect for floating oxides does not appear. While, when the amount exceeds 20%, glass film is locally formed, and a strong pickling must be carried out. Therefore, the mixing ratio of strontium- or barium-containing compound in the annealing seperator must be 0.2–20%, calculated as strontium or barium. As the strontium- or barium-containing compound, sulfate, hydroxide and the like are used.

As described above, the presence of hydrated silicate mineral is effective for removing sulfur and selenium during the final annealing, but can not remove completely over the whole width of a steel sheet when it is formed into a coil. The following Table 1 shows the distribution of the amount of sulfur remaining in the coil in its widthwise direction at the inside portion when each of 3 kinds of $Al_2O_3$ series annealing separators is applied to a decaburized steel sheet containing 0.020% of sulfur, the steel sheet is formed into a coil and the coil is arranged uprightly and subjected to a final annealing. It can be seen from Table 1 that, even in use of an annealing separator not containing $Ca(OH)_2$, the coil is sufficiently purified at the portion near the edge, but sulfur remains in the coil at the center portion in the widthwise direction unless a disulfurization agent, such as CaO or $Ca(OH)_2$, is added to the annealing separator. The presence of sulfur in the steel sheet affects adversely its magnetic properties, particularly iron loss.

TABLE 1

| Annealing separator | Amount of sulfur remaining in the finally annealed steel sheet: S in the top portion (%) | S in the center portion (%) | S in the bottom portion (%) |
|---|---|---|---|
| $Al_2O_3$ | 0.008 | 0.015 | 0.011 |
| $Al_2O_3$ + 10% serpentine | 0.002 | 0.009 | 0.003 |
| $Al_2O_3$ + 10% serpentine + 10% $Ca(OH)_2$ | <0.001 | 0.001 | <0.001 |

When the amount of CaO or $Ca(OH)_2$ contained in the annealing separator of the present invention is less than 2%, sulfur or selenium can not be completely removed. While, when the amount exceeds 30%, glass film is locally formed, and a strong pickling must be carried out. Therefore, the amount of CaO or $Ca(OH)_2$ contained in the annealing separator must be 2–30%.

As described above, according to the present invention, when a cold rolled silicon steel sheet is subjected to a decarburization annealing so as to form subscale containing 0.2–1.0 g of oxygen per $m^2$ of one surface of the steel sheet, an annealing separator consisting of 5–30% of hydrated silicate mineral fine particle, 0.2–20%, calculated as strontium or barium, of a compound containing strontium or barium, 2–30% of CaO or $Ca(OH)_2$ and the remainder being $Al_2O_3$ is applied on the subscale, and a final annealing is carried out, a grain-oriented silicon steel sheet having substantially no glass film can be obtained.

Figure 2:
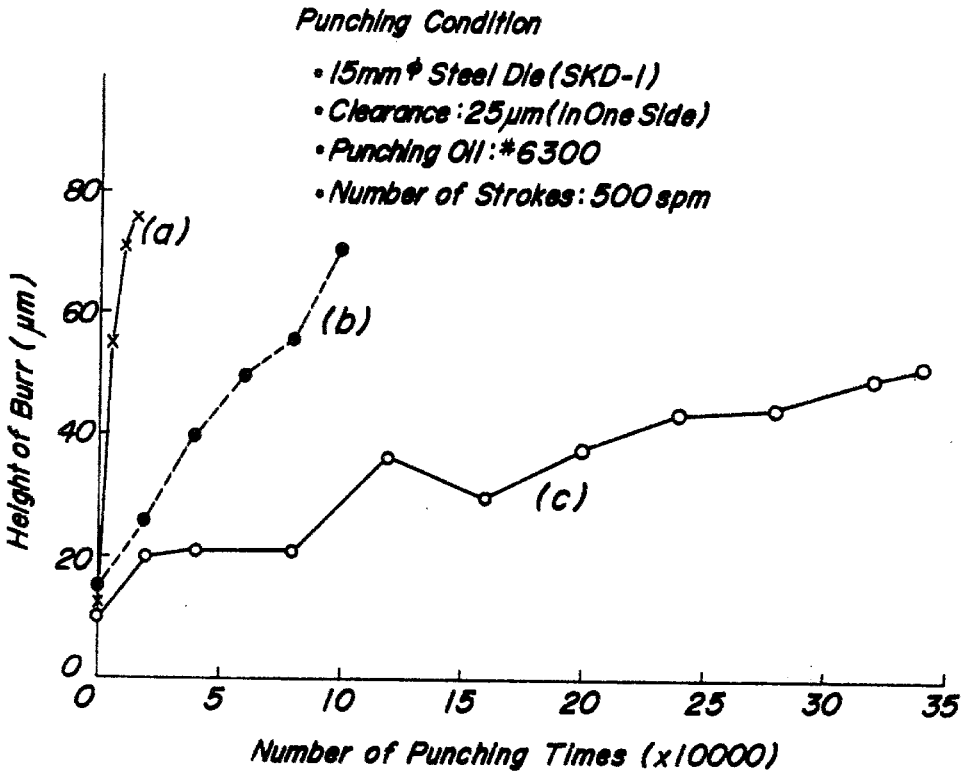
FIG. 2 is a graph showing influences of the presence of glass film and the kind of insulating coating upon the punchability of silicon steel sheet.

A phosphate system or chromate-organic resin misture system insulating coating was applied to the above described grain-oriented silicon steel sheet having substantially no glass film. For comparison, a phosphate system insulating coating was applied to a grain-oriented silicon steel sheet having a conventional forsterite film. The punchabilities of the above treated silicon steel sheets are shown in FIG. 2. It can be seem from FIG. 2 that the grain-oriented silicon steel sheet having a conventional forsterite film and a phosphate system insulating coating thereon has a punchability of only 4,000 punching times until the height of burr reaches 50 μm, but the grain-oriented silicon steel sheet having substantially no glass film according to the present invention has a high punchability of 60,000 punching times even when the steel sheet has the same phosphate system insulating coating as described above. When the grain-oriented silicon steel sheet having substantially no glass film is coated with a chromate-organic resin mixture system insulating coating, the steel sheet has a significantly high punchability of at least 300,000 punching times.

In the present invention, as the organic resin, there can be used acrylic resin, vinyl acetate resin, amino resin, alkyd resin, phenolic resin, melamine resin, silicone resin, epoxy resin and maleic acid anhydride resin and mixture thereof. As the chromate, there can be used dichromate and chromate of calcium, magnesium and zinc, mixtures of the dichromates and mixtures of the chromates. As the phosphate, there can be used magnesium phosphate and aluminum phosphate and their mixture.

The following examples are given for the purpose of illustration of this invention and are not intended as limitations thereof.

EXAMPLE 1

A silicon steel ingot containing 0.025% of C, 3.10% of Si, 0.06% of Mn and 0.02% of S was hot rolled into a thickness of 3 mm, annealed at 950° C. for 5 minutes, and then subjected to two cold rollings with an intermediate annealing at 900° C. for 3 minutes therebetween to produce a cold rolled sheet having a final guage of 0.3 mm. The cold rolled sheet was subjected to a decarburization annealing at 820° C. for 3 minutes under a wet hydrogen atmosphere. In this annealing, the oxidizing ability of the annealing atmosphere was controlled to vary the oxygen content of the resulting subscale. The decarburized steel sheet was applied with a MgO or $Al_2O_3$ series annealing separator so that the coated amount of the annealing separator on the steel sheet surface would be 15 g/$m^2$ after drying. Then, the steel sheet was subjected to a final annealing at 1,180° C. for 5 hours in hydrogen atmosphere. The magnetic properties and other properties of the finally annealed steel sheet are shown in the following Table 2.

TABLE 2

| | | | Magnetic properties and other properties of finally annealed steel sheet | | | | | | |
|---|---|---|---|---|---|---|---|---|---|
| | | | | | | | | Punchability* | |
| | | Composition of annealing separator | Oxygen content in subscale on the surface of steel sheet after decarburization annealing (g per $m^2$ of one surface) | Magnetic properties $B_{10}$ (T) | Magnetic properties $W_{17/50}$ (w/kg) | Amount of S remaining in steel (%) | Glass film | Phosphate system insulating coating | Chromate-organic resin mixture system insulating coating |
| Comparative sample | No.1 | MgO 100% | 1.0 | 1.86 | 1.25 | 0.001 | do | 5,000 | — |
| | No.2 | $Al_2O_3$ 100% | 0.8 | 1.88 | 1.25 | 0.012 | do | 20,000 | — |
| | No.3 | $Al_2O_3$ + serpentine 15% | 1.0 | 1.88 | 1.24 | 0.009 | do | — | — |
| | No.4 | $Al_2O_3$ + serpentine 10% + $Sr(OH)_2$ 10% | 1.3 | 1.89 | 1.22 | 0.007 | do | 20,000 | 60,000 |
| Sample of the present invention | No.1 | $Al_2O_3$ + serpentine 10% + $Sr(OH)_2$ 5% + $Ca(OH)_2$ 5% | 0.8 | 1.89 | 1.19 | 0.001 | none | 60,000 | 300,000 |
| | No.2 | $Al_2O_3$ + serpentine 15% + $Ba(OH)_2$ 2% + $Ca(OH)_2$ 10% | 0.5 | 1.88 | 1.18 | <0.001 | none | — | 400,000 |

*Punchability:
The number of punching times until the height of burr reaches 50 μm when steel sheets are punched by means of a steel die having a diameter of 15 mm

EXAMPLE 2

A silicon steel ingot containing 0.03% of C, 2.98% of Si, 0.055% of Mn, 0.018% of Sb and 0.020% of Se was hot rolled into a thickness of 3 mm, annealed at 970° C. for 5 minutes, and subjected to two cold rollings with an intermediate annealing at 900° C. therebetween to produce a cold rolled sheet having a final guage of 0.30 mm. The cold rolled sheet was subjected to a decarburization annealing under a wet hydrogen atmosphere, and then subjected to a final annealing under hydrogen atmosphere. In the final annealing, the cold rolled sheet was firstly kept at 850° C. for 50 hours and then kept at 1,180° C. for 10 hours. The magnetic properties and other properties of the finally annealed steel sheet are shown in the following Table 3 together with the oxygen content in the subscale formed during the decarburization annealing and the composition of the annealing separator.

TABLE 3

| | | Composition of annealing separator | Magnetic properties and other properties of finally annealed steel sheet: Oxygen content in subscale on the surface of steel sheet after decarburization annealing (g per $m^2$ of one surface) | Magnetic properties: $B_{10}$ (T) | Magnetic properties: $W_{17/50}$ (w/kg) | Amount of S remaining in steel (%) | Glass film | Punchability: Phosphate system insulating coating | Punchability: Chromate-organic resin mixture system insulating coating |
|---|---|---|---|---|---|---|---|---|---|
| Comparative sample | No.1 | MgO 100% | 1.1 | 1.91 | 1.12 | 0.001 | do | 5,000 | — |
| | No.2 | $Al_2O_3$ 100% | 0.6 | 1.92 | 1.11 | 0.010 | do | 40,000 | — |
| | No.3 | $Al_2O_3$ + serpentine 10% | 0.8 | 1.93 | 1.09 | 0.005 | do | 40,000 | 70,000 |
| | No.4 | $Al_2O_3$ + $Ba(OH)_2$ 5% | 1.0 | 1.93 | 1.10 | 0.007 | do | 30,000 | — |
| Sample of the present invention | No.1 | $Al_2O_3$ + serpentine 10% + $Ba(OH)_2$ 5% + $Ca(OH)_2$ 10% | 0.6 | 1.94 | 1.06 | <0.001 | none | 70,000 | 300,000 |
| | No.2 | $Al_2O_3$ + serpentine 10% + $Ba(OH)_2$ 1% + $Ca(OH)_2$ 5% | 0.4 | 1.93 | 1.06 | <0.001 | none | — | — |

It can be seen from Examples 1 and 2 that, when a cold rolled silicon steel sheet is subjected to a decarburization annealing so as to form subscale containing 0.2–1.0 g of oxygen per $m^2$ of one surface of the steel sheet, and the decarburized steel sheet is applied with an annealing separator consisting of 5–30% of hydrated silicate mineral fine particle, 0.2–20%, calculated as strontium or barium, of a compound containing strontium or barium, 2–30% of CaO or $Ca(OH)_2$ and the remainder being $Al_2O_3$, and then subjected to a final annealing, a grain-oriented silicon steel sheet having excellent magnetic properties and having substantially no glass film can be obtained. Moreover, when an organic resin system insulating coating is formed on the above obtained grain-oriented silicon steel sheet, the punchability of the coated steel sheet is remarkably superior to the punchability of a grain-oriented silicon steel sheet having a conventional phosphate system insulating coating.

What is claimed is:

1. In a method of producing grain-oriented silicon steel sheets having substantially no glass film, wherein a cold rolled silicon steel sheet having a final guage is subjected to a decarburization annealing to form subscale on the surface of the steel sheet, an annealing separator consisting mainly of $Al_2O_3$ is applied on the subscale and then the steel sheet is subjected to a final annealing, an improvement comprising using an annealing separator consisting of 5–30% of finely particulate serpentine, 0.2–20%, calculated as strontium or barium, of compound containing strontium or barium, 2–30% of CaO or $CA(OH)_2$ and the remainder being $Al_2O_3$.

2. A method according to claim 1, wherein the decarburization annealing is carried out so as to form subscale containing 0.2–1.0 g of oxygen per $m^2$ of one surface of the steel sheet.

3. A method according to claim 1, wherein an insulating coating consisting of magnesium phosphate and/or aluminum phosphate is formed on the surface of the grain-oriented silicon steel sheet having substantially no glass film.

4. A method according to claim 1, wherein an insulating coating consisting of a mixture of a chromate selected from dichromate and chromate of calcium, magnesium and zinc, mixtures of dichromates and mixtures of chromates, and a resin selected from acrylic resin, vinyl acetate resin, amino resin, alkyd resin, phenolic resin, melamine resin, silicone resin, epoxy resin and maleic acid unhydride resin and mixtures thereof, is formed on the surface of the grain-oriented silicon steel sheet having substantially no glass film.

* * * * *